US005485683A

United States Patent [19]

Morgan

[11] Patent Number: 5,485,683

[45] Date of Patent: Jan. 23, 1996

[54] CENTRIFUGE EXTRACTOR

[75] Inventor: Glenn D. Morgan, Powhatan, Va.

[73] Assignee: Charles M. Neal, Richmond, Va.; a part interest

[21] Appl. No.: 207,213

[22] Filed: Mar. 8, 1994

[51] Int. Cl.[6] ..... B26B 17/30; B26B 17/24

[52] U.S. Cl. ..... 34/58; 34/322; 210/360.1

[58] Field of Search ..... 34/58, 312, 313, 34/316, 318, 322; 210/360.1

[56] References Cited

U.S. PATENT DOCUMENTS

| | | | |
|---|---|---|---|
| 1,416,125 | 5/1922 | Prestwich | 34/58 |
| 1,691,042 | 11/1928 | Bell | 34/109 |
| 3,688,906 | 9/1972 | Ferrara | 210/152 |
| 3,738,490 | 6/1973 | Tigerman | 210/145 |
| 3,771,334 | 11/1973 | Quackenbush | 68/18 |
| 3,998,656 | 12/1976 | Grotto | 134/33 |
| 4,090,310 | 5/1978 | Koff | 34/58 |
| 4,512,088 | 4/1985 | Clapper | 34/58 |

*Primary Examiner*—Henry A. Bennet
*Assistant Examiner*—William C. Doerrler
*Attorney, Agent, or Firm*—Laubscher & Laubscher

[57] ABSTRACT

A centrifuge extractor designed for reclaiming industrial fluids from absorbent matts and pads is characterized by a fixed cylindrical housing and a rotating cylindrical screen concentrically arranged within the housing to define inner and outer housing chambers. With fluid laden matts and pads arranged in the inner chamber, the screen is rotated to separate the fluids from the matts and pads. The fluids pass through the screen and exit the outer chamber through an outlet at the bottom thereof. The fluids pass through coarse and fine particulate filters. Thus, the matts and pads are reusable and the fluids may be reused or recycled.

4 Claims, 4 Drawing Sheets

CENTRIFUGE EXTRACTOR

BACKGROUND OF THE INVENTION

In an industrial environment, leaks from machinery and other heavy equipment are a continual problem. Oils and solvents leaking from the machinery collect on the floor and create a hazardous and messy environment. Accordingly, it is common to spread absorbent clays or other porous materials on the floor to absorb spilled or leaking industrial fluids. It is also conventional to wipe up such fluids with absorbent matts, pads, pillows, or socks. The absorbent clays are not reusable and thus must be discarded in landfills. Similarly, it is difficult to clean absorbent matts, pads, and the like, so they are often discarded as well.

The present invention relates to a centrifuge extractor which facilitates extraction and reclamation of fluids and re-use of the absorbent pads and matts. The reclamation of industrial fluids and cleansing of the absorbent matts and pads eliminates their disposal in landfills and allows re-use of these recyclable products.

BRIEF DESCRIPTION OF THE PRIOR ART

Centrifugal extractors are well-known in the patented prior art as evidenced by the U.S. patents to Clapper U.S. Pat. No. 4,512,088 and Prestwich U.S. Pat. No. 1,416,125. The Clapper patent, for example, discloses a centrifugal extractor for removing fluid from rotary air filters. The extractor includes lower and upper supports for mounting and surrounding the filter and rings to retain the filters in place during rotation.

While the prior devices operate satisfactorily, they are not suitable for removing fluids, and particularly thick fluids, such as oil and solvent, from heavy or bulky matts and pads. These materials have a higher density and require significant centrifugal forces which are difficult for the prior devices to produce. Moreover, the prior extractors do not include filters for cleansing and recycling the extracted fluid.

The present invention was developed in order to overcome these and other drawbacks of the prior devices by providing a portable centrifuge extractor of simplified construction suitable for removing fluids and solvents from matts and pads which also filters particulates from the fluids. With the improved extractor, the matts and pads may be re-used and the collected fluids may be recycled.

SUMMARY OF THE INVENTION

Accordingly, it is a primary object of the invention to provide an improved centrifuge extractor including a fixed cylindrical housing defining a centrifuge chamber. The housing has a vertical axis and a lower fluid outlet and is open at its upper end. A cylindrical screen is concentrically arranged within the housing in spaced relation therewith to define inner and outer housing chambers. The screen is rotatably connected with the housing and is also open at its upper end. A motor is provided for rotating the screen with respect to the housing. When matts and pads bearing fluids such as oil or solvents are placed in the housing inner chamber and the screen is rotated, the oil and solvents will pass from the matts and pads through the screen to the housing outer chamber owing to centrifugal force, and then to the fluid outlet by gravity. A filter is connected with the housing fluid outlet to remove particulates from the extracted oil and solvents.

According to another object of the invention, a pump is connected with the housing fluid outlet to pump fluid from the housing through the filter. A second filter is connected with the outlet of the pump to remove further particulates from the fluid. The pump is also driven off of the motor. A pulley and drive belt system is provided to connect the drive output from the motor with the screen and the pump for operation thereof.

It is a further object to provide the centrifuge extractor on a portable cart for mobility. The cart includes a pivotal cover which affords access to the housing chamber and removable filter tray which comprises the second filter of the extractor. The fluid output from the pump passes through the filter tray into a holding pan on the cart which collects the filtered fluid.

BRIEF DESCRIPTION OF THE FIGURES

Other objects and advantages of the invention will become apparent from a study of the following specification, when viewed in the light of the accompanying drawing, in which.

DETAILED DESCRIPTION

Figure 1:
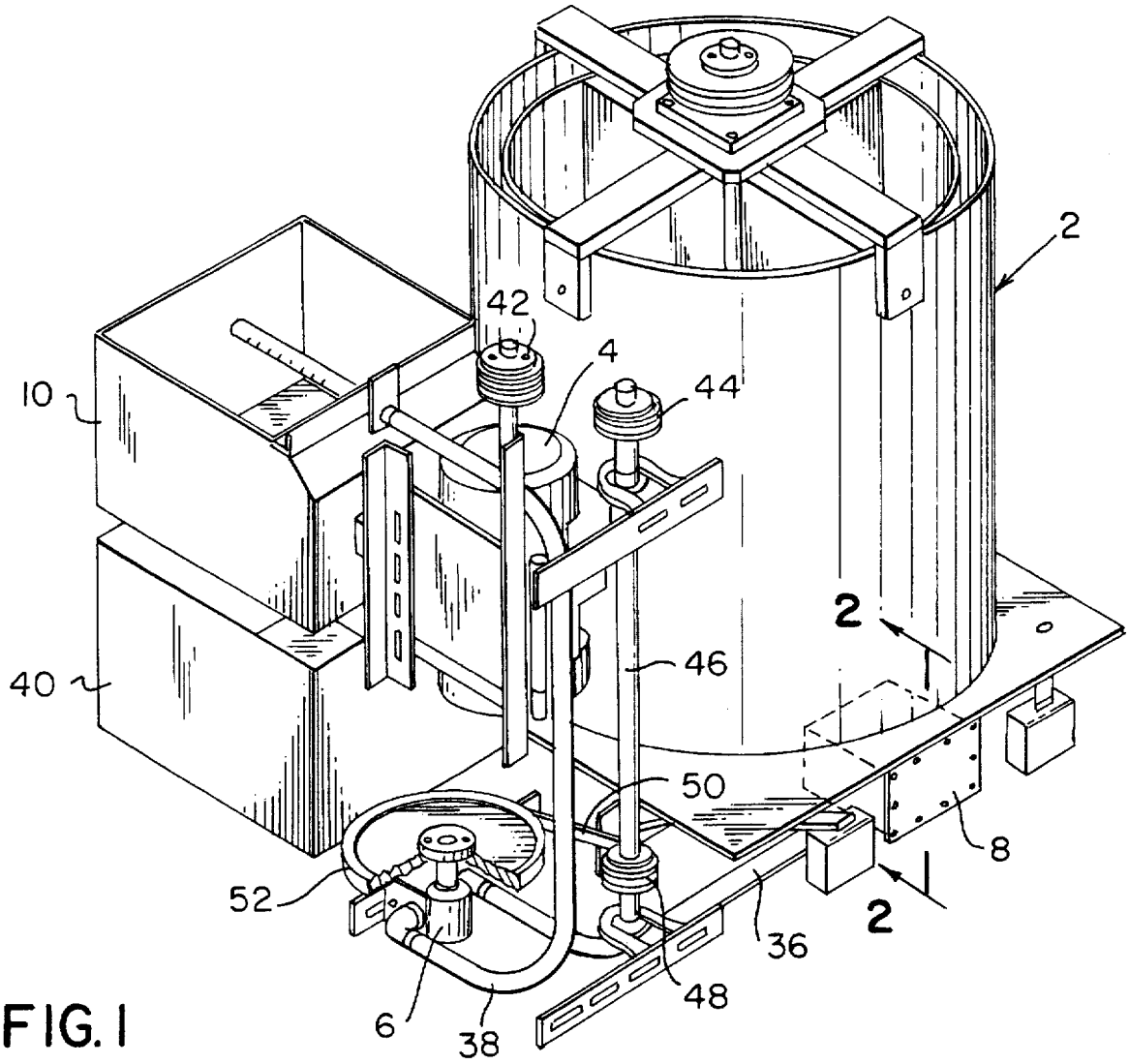
FIG. 1 is a perspective view of the centrifuge extractor according to the invention.

Referring to FIG. 1, there is shown the preferred embodiment of the centrifuge extractor according to the invention. The basic components of the extractor include a centrifuge 2, a drive motor 4, a pump 6, a coarse particulate filter assembly 8, and a fine particulate filter assembly 10. The extractor can be used to remove fluids from fabrics, but is especially adapted for cleaning industrial matts, pads, rags, and the like by separating heavy industrial fluids such as oil and solvents therefrom.

Figure 3:
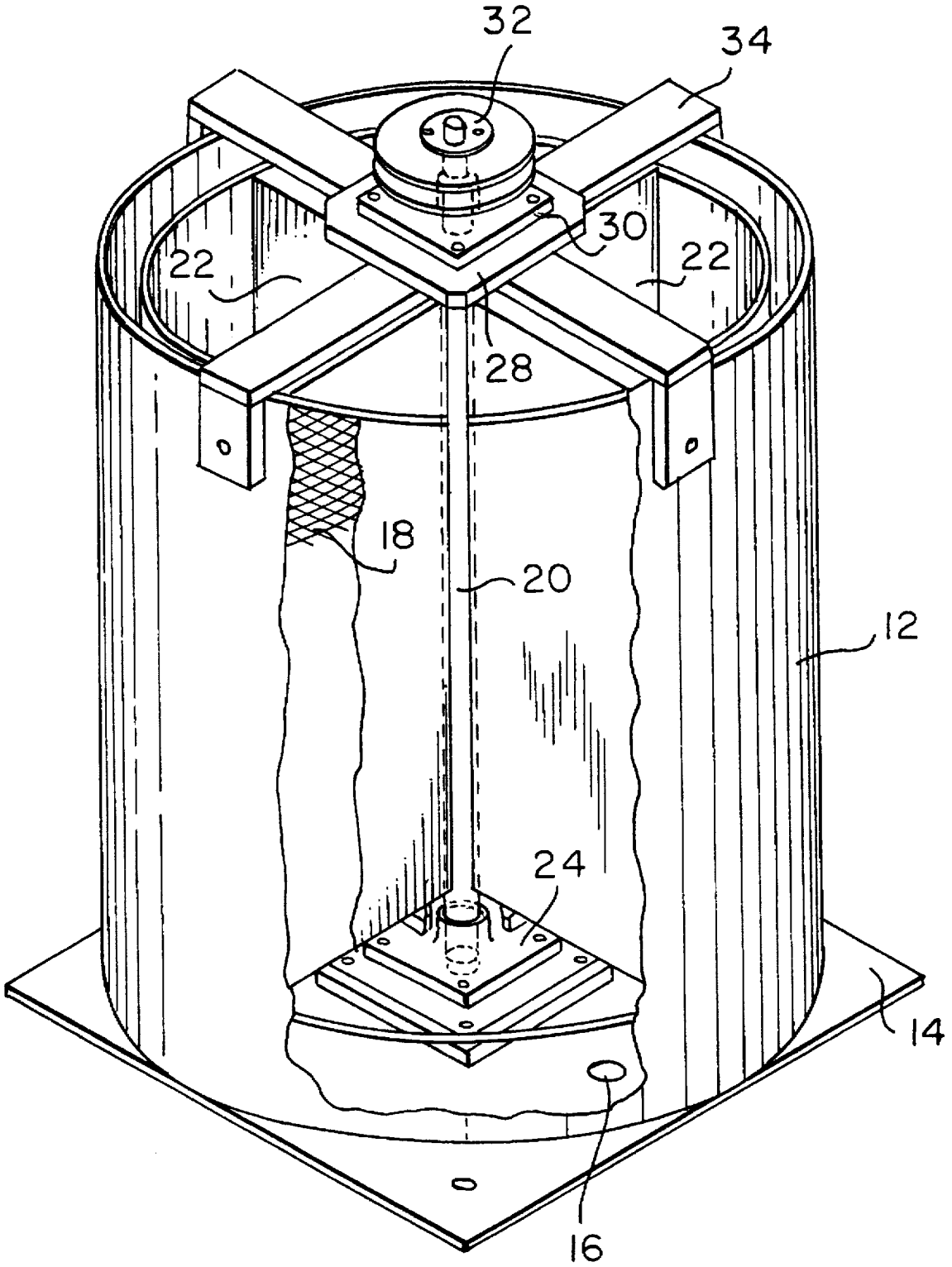
FIG. 3 is a partial cutaway perspective view of the housing of the extractor of FIG. 1.
Figure 4:
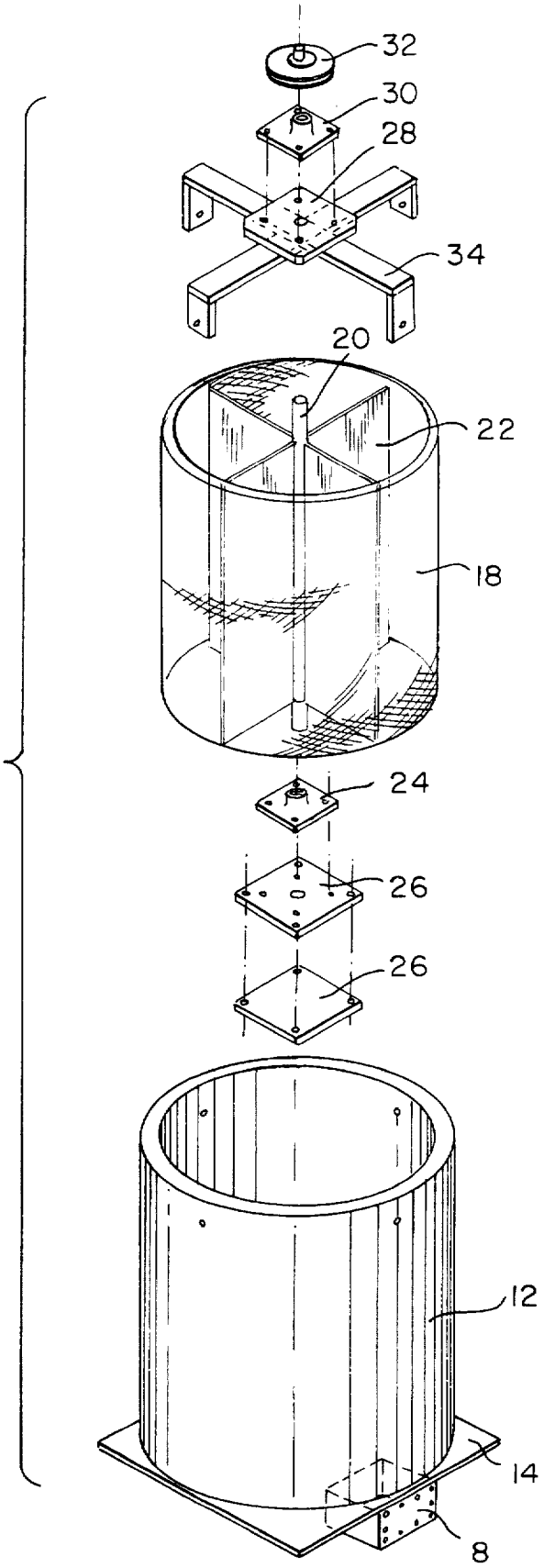
FIG. 4 is an exploded view of the centrifuge housing of FIG. 3.

The centrifuge 2 is shown in greater detail in FIGS. 3 and 4. It includes an outer cylindrical housing 12 which is mounted in fixed relation on a base 14. The housing has a vertical axis and is open at its upper end. The base 14 closes the lower end of the housing, but contains a fluid outlet opening 16 leading to the coarse particulate filter 8 as will be described below.

The cylindrical housing defines a centrifuge chamber within which is arranged a cylindrical screen 18. The screen is concentrically arranged within the housing in spaced relation from the inner surface of the housing to divide the centrifuge chamber into inner and outer chambers. As with the housing, the screen is open at its upper end and closed by the base 14 at its lower end. The fluid outlet opening 16 is arranged in the base at the bottom of the outer chamber. The screen 18 is not connected with the base 14. Rather, it is rotatable with respect to the housing and the base.

As best shown in FIG. 4, the screen includes an axial shaft 20 and a plurality of radially extending dividing walls 22 connected between the shaft and the screen to divide the inner centrifuge chamber into a plurality of compartments generally equal in volume. The lower end of the shaft 20 rests in and rotates with respect to a bearing support block 24 connected with mounting plates 26 which in turn are fastened with the base by suitable fasteners such as bolts. The top of the shaft passes through an upper mounting plate 28 and bearing block 30 and has a pulley 32 fixed thereon. The upper mounting plate is connected with a framework 34 bolted to the housing as shown in Fig, 3. The pulley 32, shaft 20, dividing walls 22, and screen 18 thus rotate as a unit with respect to the fixed housing 12 as will be developed below.

Referring once again to FIG. 1, the pump 6 is connected with the coarse filter assembly 8 via a first conduit 36 and with the fine filter assembly via a second conduit 38 to transport fluid from the bottom of the outer centrifuge chamber through the coarse and fine filters. Beneath the fine filter assembly is a holding pan 40 which collects filtered fluids.

Figure 2:
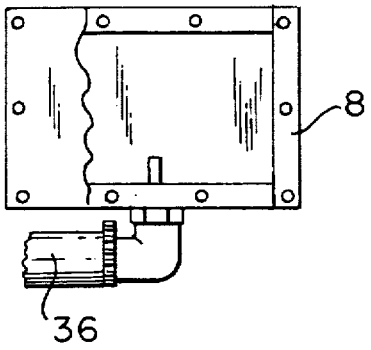
FIG. 2 is a partial sectional view taken along line 2—2 of FIG. 1.

The coarse filter assembly 8 preferably comprises a trap as shown in FIG. 2 to collect large pieces of debris suspended in the fluid. The side of the trap which preferably comprises a screen (not shown) can be removed to extract particles that accumulate in the trap. The fine filter assembly 10 comprises a sliding filter tray for removing small particulates from the fluid.

Rotation of the centrifuge screen 18 and operation of the pump are controlled by operation of the motor 4. The motor produces a rotary output which turns a double pulley 42. A drive belt (not shown) is arranged between a portion of the double pulley 42 and the pulley 32 on the screen shaft 20 so that the screen is rotated off of the output of the motor. A second drive belt (not shown) is connected with another portion of the double pulley 42 and a pulley 44 of a pump drive shaft 46. The shaft 46 transfers rotation of the pulley 44 to a lower pulley 48. A drive belt 50 is connected between the pulley 48 and a pulley 52 connected with the pump 6. Thus, the pump is also operated off of the output of the motor. By providing a pulley of a different diameter, the pump can be driven at a different rotational speed than the screen.

Figure 5:
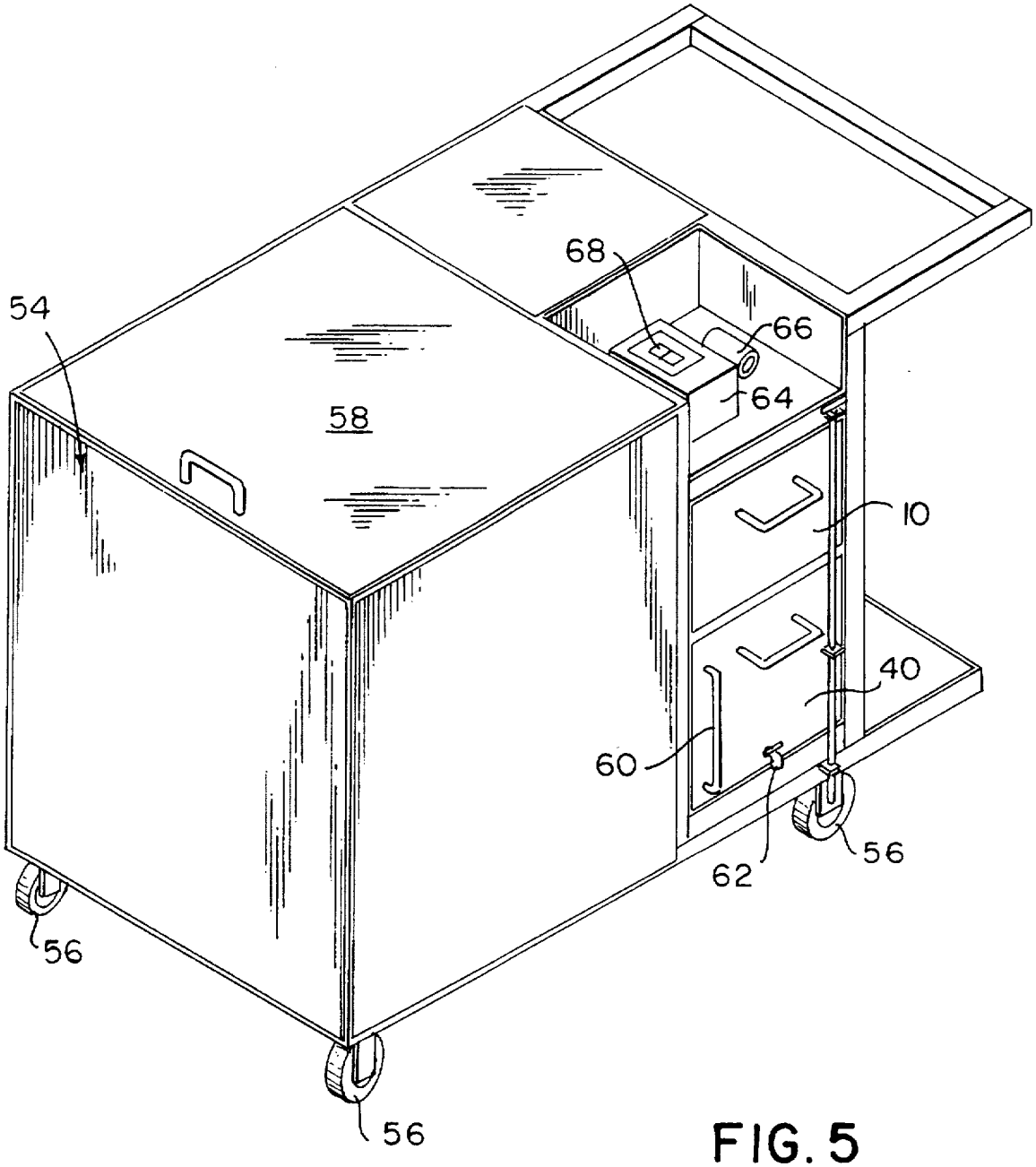
FIG. 5 is a perspective view of the cart within which the extractor of FIG. 1 is arranged for portability.

The centrifuge extractor of FIGS. 1–4 is preferably mounted on a portable cart 54 as shown in FIG. 5. The cart has caster wheels 56 and the centrifuge extractor is arranged beneath a locking cover 58. The sliding filter tray of the fine particulate filter assembly 10 and the holding pan 40 comprise drawers on the cart. The holding pan 40 includes a fluid level sight glass 60 which provides an indication of the fluid level in the pan 40 and a drain valve 62.

The cart cover 58 opens to enable loading of the centrifuge housing. A time-locking device (not shown) on the cover insures that the coves is locked during operation. The locking device will not release until the screen has come to a complete stop. A controller 64 and lockout-key switch 66 are located on the cart, and start/stop buttons 68 are proved on the controller to activate the motor 4.

OPERATION

Access to the centrifuge is provided through the cover 58 when unlocked by operation of the key switch 66. Fluid soaked matts or pads are evenly loaded into the compartments of the inner centrifuge chamber and the cover 58 is closed. Power is supplied to the motor by activating the start button 68. The motor drives the screen and pump via the pulley/drive belt drive system. The screen is rotated at approximately 800 RPM's and extracts fluids contained in the absorbent matts and pads by centrifugal force. Although the screen can be rotated for any time period under control of the controller, after about ten minutes approximately 95% of the fluids are removed.

The extracted fluids flow through the screen under the influence of centrifugal force to the inner surface of the housing. They then flow to the outlet opening 16 by gravity. The coarse particulate filter assembly 8 traps large particles in the fluid and the pump 4 draws the filtered fluid from the housing to the fine particulate filter assembly 10 which has a finer mesh filter screen for removing smaller particles from the fluid. The twice filtered fluid is collected in the holding pan 40.

When the motor is deactivated (by either a timer or the stop switch), the screen slows and takes approximately twenty-five seconds to stop. The time-locking device on the cover releases twenty-five seconds after the power is terminated allowing the operator to pivot the cover to the open position for removal of the absorbent matts and pads for their re-use.

The filtered fluids can be re-used or recycled as necessary. The ability to re-use the fluids provides major savings by eliminating the need for absorbent clays, by reducing fluid-purchasing requirements, by avoiding the escalating costs of disposing of contaminated fluids and clays, and by reclaiming usable absorbent matts and pads. The centrifuge extractor of the invention provides the user with an environmentally safe manner of dealing with oil and other fluid residues resulting from manufacturing operations.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A mobile centrifuge extractor for removing fluids from mats and pads, comprising (a) a cart;

(b) a fixed cylindrical housing mounted on said cart and defining a centrifuge chamber, said outlet, and an open upper end;

(c) a cylindrical screen concentrically arranged in spaced relation within said housing to define inner and outer housing chambers, said screen being rotatably connected with said housing and having an open upper end;

(d) a plurality of radially arranged divider walls connected with said screen within said inner chamber for dividing said inner chamber into a plurality of compartments;

(e) an axial shaft connecting said divider walls;

(f) bearing means connected with said housing for supporting said axial shaft for rotation relative to said housing;

(g) a coarse filter connected with said housing lower fluid outlet for removing coarse particulates from the fluid;

(h) a pump connected with said coarse filter for drawing fluid from said housing through said coarse filter;

(i) drive means including a drive motor connected with said cart, a first belt and pulley assembly connected between said drive motor and said axial shaft, and a second belt and pulley assembly connected between said drive motor and said pump;

(j) a fine filter tray connected with an outlet of said pump for removing fine particulates from the fluid; and (k) a holding pan arranged beneath said filter tray for collecting filtered fluid, whereby when fluid soaked mats or pads are loaded into said compartments and said screen is rotated, fluid from the mats and pads is extracted by centrifugal force, drawn from said housing lower fluid outlet through said coarse particulate filter, pumped through said fine filter tray, and collected in said holding pan.

2. A centrifuge extractor as defined in claim 1, wherein said car includes a cover pivotable between open and closed positions to afford access to said housing chamber.

3. A centrifuge extractor as defined in claim 2, and further comprising a controller for controlling the operation of said motor and release of said cover for pivotal movement to the open position.

4. A mobile centrifuge extractor for removing fluids from mats and pads, comprising (a) a cart;

(b) a fixed cylindrical housing mounted on said cart and defining a centrifuge chamber, said housing having a vertical axis and a lower fluid outlet and being open at its upper end;

(c) a cylindrical screen concentrically arranged in spaced relation within said housing to define inner and outer housing chambers, said screen being rotatably connected with said housing and having an open upper end;

(d) a plurality of radially arranged divider walls connected with said screen within said inner chamber for dividing said inner chamber into a plurality of compartments;

(e) an axial shaft connecting said divider walls;

(f) bearing means connected with said housing for supporting said axial shaft for rotation relative to said housing;

(g) first filter means connected with said housing lower fluid outlet for removing coarse particulates from the fluid;

(h) a pump connected with said first filter means for drawing fluid from said housing through said first filter means;

(i) drive means connected with said cart for rotating said cylindrical screen and driving said pump;

(j) second filter means connected with an outlet of said pump for removing fine particulates from the fluid; and (k) means arranged beneath said second filter means for collecting filtered fluid, whereby when fluid soaked mats or pads are loaded into said compartments and said screen is rotated, fluid is extracted from the mats and pads by centrifugal force, drawn from said housing lower fluid outlet through said first filter means, pumped through said second filter means, and collected in said collecting means.

* * * * *